US006041211A

United States Patent [19]

Hobson et al.

[11] Patent Number: 6,041,211

[45] Date of Patent: Mar. 21, 2000

[54] CLEANING ASSEMBLY FOR CRITICAL IMAGE SURFACES IN PRINTER DEVICES AND METHOD OF USING SAME

[75] Inventors: Alex R. Hobson, Elkton, Md.; F. Michael J. McCollam, Fife, United Kingdom; Beth P. Powell, Elkton, Md.

[73] Assignee: W. L. Gore & Associates, Inc., Newark, Del.

[21] Appl. No.: 08/659,600

[22] Filed: Jun. 6, 1996

[51] Int. Cl.[7] ..... G03G 21/00; G03G 15/20

[52] U.S. Cl. ..... 399/352; 15/256.5; 399/327

[58] Field of Search ..... 399/327, 352, 399/325, 326; 15/1.51, 256.5, 256.51

[56] References Cited

U.S. PATENT DOCUMENTS

| | | | |
|---|---|---|---|
| 3,953,566 | 4/1976 | Gore | 264/288 |
| 3,962,153 | 6/1976 | Gore | 260/2.5 R |
| 4,096,227 | 6/1978 | Gore | 264/210 R |
| 4,187,390 | 2/1980 | Gore | 174/102 R |
| 4,530,596 | 7/1985 | Kawamoto et al. | 355/15 |
| 4,686,132 | 8/1987 | Sumii et al. | 428/171 |
| 4,842,944 | 6/1989 | Kuge et al. | 428/451 |
| 4,862,221 | 8/1989 | Tabuchi et al. | 355/300 |
| 5,036,551 | 8/1991 | Dailey | 428/297 |
| 5,478,423 | 12/1995 | Sassa et al. | 118/60 |
| 5,534,986 | 7/1996 | Irro et al. | 399/325 |

FOREIGN PATENT DOCUMENTS

| | | |
|---|---|---|
| 0479564 A2 | 4/1992 | European Pat. Off. . |
| 0696766 A1 | 2/1996 | European Pat. Off. . |
| 2-115883 | 4/1990 | Japan . |
| 4-83283 | 3/1992 | Japan . |
| 5-119688 | 5/1993 | Japan . |
| 2 242 431 | 5/1994 | United Kingdom . |
| 2284813 | 6/1995 | United Kingdom . |

*Primary Examiner*—Arthur T. Grimley
*Assistant Examiner*—Quana Grainger
*Attorney, Agent, or Firm*—Carol A. Lewis White

[57] ABSTRACT

The present invention provides an improved cleaning material for critical imaging surfaces for use in a variety of printers, including laser printer, plain paper copiers and facsimile machines, etc. Moreover, the present invention utilizes the unique properties of expanded PTFE and sintered PTFE as the cleaning medium.

17 Claims, 9 Drawing Sheets

CLEANING ASSEMBLY FOR CRITICAL IMAGE SURFACES IN PRINTER DEVICES AND METHOD OF USING SAME

BACKGROUND OF THE INVENTION

1. Field of the Invention

The present invention relates to a material and apparatus for cleaning critical imaging surfaces in various printer devices.

2. Description of the Related Art

In conventional plain paper copying machines the image is typically formed on a photoconductor, transferred to the paper, and subsequently passed through a thermal fixation roll and a pressure roll. The image is created by toner which is typically a mixture of a thermoplastic and carbon. As the paper passes through the nip, the toner which faces the hot fixation roll melts and flows into the paper. This area of copiers and printers is typically referred to as the "fuser".

The image which is created by the toner is transferred to multiple surfaces. It is important to achieve high levels of transfer of the image from one surface to another. When incomplete transfer occurs, it is necessary to clean any residual toner off of the surface, or the non-transferred toner will be deposited on subsequent pages, thus causing "offset". Offset is any undesirable marks, spots, or smears that may appear on a printed sheet. Any surface that is involved with forming or transferring the image will hereafter be referred to as a "critical image surface". Critical image surfaces include, but are not limited to, photoconductors, other image forming surfaces such as rollers or drums, paper feed rollers or belts which transfer the paper containing the image, intermediate image transfer surfaces such as belts or rollers, and fuser rollers or belts which fix the image to the paper.

The primary imaging surface in conventional printers, typically a photoconductor, is typically an aluminum mandrel coated with one or more photoconductive materials, such as selenium or the like. It is extremely important to keep this surface clean and free of surface defects. It is therefore important to clean the photoconductor surface with a material that is non-abrasive. Abrasion to the photoconductor surface may lead to inadequate image formation, excess ionization of the surface, poor image transfer, and recurring offset.

The fuser rollers typically comprise a heated fixation roller and an elastomeric pressure roller. The trend in the non-impact printing industry is to coat these rollers with a fluoropolymer layer which acts as a release surface and decreases the amount of offsetting. The non-stick fluoropolymer layers are used in conjunction with a release agent, typically silicone oil. In order to prevent the toner from sticking to the fixation roll during fusing of the image, a release agent is typically applied to the fixation roller. Silicone oil, or dimethylsiloxane, is currently the release agent of choice in most copier and printer applications. The release agent is transferred to the paper during fusing. When an insufficent amount of release agent is present on the fixation roller, the toner will become adhered to the fixation roller during the fusing process and can become deposited on subsequent pages, creating offset. With the use of fluoropolymer release layers, the amount of silicone oil needed to prevent offsetting has been dramatically reduced. Moreover, in some printers, no release agent is used.

Other critical surface components within the printer are also currently being coated with release layers. For example, paper transfer belts are commonly spray coated with a release material to promote efficient image transfer. However, with these release coatings some offsetting occurs.

The trend in the non-impact printing industry is to produce images with higher resolution. This means that there are more dots per inch (DPI) on prints and copies. In order to achieve this finer resolution, the toner particle size must be smaller, which has led to some problems in controlling the particles. The small particles are more difficult to transfer from one surface to another, they float about more readily, and thus often result in undesirable coatings on certain surfaces. In addition, the smaller particles are more easily caught or trapped in grooves, pockets or other surface defects of the critical image surface. It is also more difficult to clean these smaller particles off of critical image surfaces. The existing cleaning materials are not only inadequate at cleaning these small particles, but also are abrasive, which leads to increased critical image surface wear.

The trend in the non-impact printing industry is to provide materials and methods of cleaning that are less abrasive to the critical image surfaces, especially the photoconductor. In light of the smaller toner particles, the cleaning material must be extremely conformable to the surface to be cleaned.

Most of the conventional cleaning materials used in this industry are nonwoven mixed fiber webs. For example, initially a high temperature fiber material such as aramid fiber was made into a light nonwoven web using a binder to hold the web together. This material worked well in some applications, but caused a variety of problems in others. The high temperature aramid fiber is coarse and abrasive and is not suitable for delicate critical image surfaces, such as the photoconductor.

In order to provide a more conformable and less abrasive cleaning material, thermoplastic fibers were mixed with the aramid fibers in the nonwoven, such as is Japanese Laid Open Patent Application (Kokai) No. 5-119688, to Teijin Ltd. This publication discloses that the mix of fibers provides a less abrasive and better cleaning surface. While the thermoplastic fibers are less abrasive, use of these materials is severely limited by the temperature limitations of thermoplastic fibers. Typically, polyester fiber is the thermoplastic fiber of choice which will melt and become weak at fusing temperatures of 180° to 220° C. If the polyester is left on the fuser for too long, it can become fused to the fuser roller and cause system failures.

Another approach is to use a mixture of higher temperature fibers as described in Japan Laid Open Patent Application (Kokai) No. 4-83283 to Japan Vilene Co., Ltd. In this application, a mixture of aromatic polyamide fibers and undrawn polyphenylene sulfide (PPS) fibers are blended together in a nonwoven cleaning web. The fibers are thermally compressed under a temperature at which the undrawn PPS fibers are plasticized and act to fuse the fibers together. This mixture of fibers is capable of higher thermal stability and can be used in high speed printing applications where the fusing temperatures are raised. Because the printing speed is increased, the paper is not in contact with the fuser roller for as long a period of time. Therefore, the temperature of the fuser must be increased in order to provide sufficient heat energy to properly fuse the image. The fibers used in this application typically have a denier of 1 to 20.

Another approach, as described in Japanese Laid -Open (Kokai) No. 2-115883 to Canon Inc., is to use fluororesin fibers in the nonwoven web. The fluororesin material is less abrasive and has the high temperature capabilities needed for fusing temperatures. The amount of fluoropolymer fiber used in the nonwoven is, however, limited due to strength.

If more than 80% fluororesin fiber is used, the mechanical properties are not acceptable for the cleaning web application.

Yet another approach described in U.S. Pat. No. 4,862,221 to Minolta Camera Kabushiki Kaisha, comprises a cleaning web with a concave-convex pattern. The purpose of the pattern is to improve the cleaning and contaminate holding capabilities of the web. In addition, U.S. Pat. No. 4,686,132 to Japan Vilene Co., Ltd., comprises a nonwoven cleaning web of aramid and polyester fiber having sealed portions and non-sealed portions. Again, the purpose of the sealed portions is to improve the cleaning performance of the web.

These publications are representative of cleaning webs which have been adapted to meet a variety of needs. However, to date, the art has been unable to provide an apparatus for cleaning the critical imaging surfaces in non-impact printing devices which is conformable, non-abrasive, thermally stable, microporous, and durable.

Accordingly, it is a primary purpose of the present invention to provide an apparatus for cleaning the critical imaging surfaces in non-impact printing devices which is conformable, non-abrasive, thermally stable, microporous, and durable. Moreover, further purposes of the present invention include:

(1) providing a cleaning apparatus material that utilizes microporous PTFE as the contaminate holding reservoir that is indexed by the critical imaging surface;
(2) providing a thin cleaning apparatus material that reduces the space taken up by the apparatus;
(3) providing a cleaning apparatus material that is substantially more conformable to contaminate scratches, and defects in or on the critical image surface than conventional materials;
(4) providing a cleaning apparatus material that is less abrasive than conventional nonwovens;
(5) providing a cleaning apparatus material that is strong;
(6) providing a cleaning apparatus material that has low frictional characteristics;
(7) providing a cleaning apparatus material that can easily incorporate fillers to alter the properties of the apparatus;
(8) providing a cleaning apparatus material that can be thermally embossed in order to improve the contamination holding capacity;
(9) providing a cleaning apparatus material with a high consistency in thickness and density;
(10) providing a cleaning apparatus material that can present a 100% fluoropolymer surface to the critical imaging surfaces; and
(11) providing a cleaning apparatus that can continually coat a critical imaging surface with a fluoropolymer release layer.

These and other purposes of the present invention will become evident based upon a review of the following specification.

SUMMARY OF THE INVENTION

The present invention provides an improved cleaning material for critical imaging surfaces for use in a variety of printers, including laser printers, plain paper copiers and facsimile machines, etc.

The present invention utilizes the unique properties of microporous membranes, including polytetrafluoroethylenes (PTFE), such as expanded PTFE and sintered PTFE, polypropylenes, and the like (hereafter referred to for convenience as "microporous membranes") as the cleaning medium.

The cleaning apparatus of the present invention may comprise any of a number of desirable forms, such as a web, a pad, a roller or the like.

In one embodiment of the present invention, the microporous membrane may be contacted with the critical imaging surface in the form of a cut sheet, or pad, with some means to press the cleaner against the critical imaging surface. In addition, the microporous membrane may be attached to a backing material. Moreover, a combination of two or more microporous membranes may be utilized in the cleaner pad configuration. For example, an ePTFE membrane may be used in combination with a sintered PTFE or a comparable woven or non-woven material.

In another embodiment of the present invention, the microporous membrane may be applied to a critical image surface in the form of a roller. For example, the microporous membrane may be wrapped or pulled over the shaft of a roller and then mounted in a manner to permit contact of the roller with the critical imaging surface. The microporous membrane may comprise, for example, a wrapped sheet, an extruded expanded tube, or the like. In addition, multiple microporous membranes may be used in combination in the roller configuration. For example, in one embodiment, a sheet of sintered PTFE may be wrapped around a roller mandrel, then an extruded tube of ePTFE membrane may be pulled over the wrapped mandrel. In a further embodiment, a woven or nonwoven textile may be placed onto the mandrel as a component of the substrate, then the microporous membrane may be applied to the substrate. In an alternative embodiment specifically for fluid cleaning, the mandrel may have one or more holes therein, or may comprise a porous material, whereby a vacuum could be pulled from the interior of the mandrel to collect the fluid that is collected by the microporous membrane.

In another embodiment of the present invention, the cleaning apparatus of the present invention may comprise a web comprising a layer of microporous PTFE either as a single layer or bonded to a backing material, such as a plastic film or fabric. The microporous PTFE is affixed to an indexing mechanism which moves the web material across the critical imaging surface, in order to bring unused web material in contact with the critical imaging surface over the life of the web. Most typically, the web is affixed to two shafts, and the web material is wound around the payoff shaft to form a cylindrical roll of web material that can be indexed across the critical imaging surface. In most applications an elastomeric roller is used to press the web material against the critical imaging surface, to ensure proper contact and to provide some pressure for cleaning offset toner, paper dust and other contamination from the critical imaging surface.

As the web indexes, the microporous PTFE conforms to the critical imaging surface and picks up and removes any contaminates. The microporous nature of the PTFE allows the contaminate to be held tightly in the structure. When the cleaning web is used on a fuser, the molten toner will wick into the microporous structure and be held tightly and indexed away. The rate of indexing is set to ensure proper cleaning of the critical imaging surface.

In some cases, the contaminate may not be just a solid particle of toner or paper dust, but it may be a fluid such as excess release agent. In these cases, the microporous PTFE cleaning material of the present invention is ideal because the microporous PTFE provides a structure for the excess release agent, or oil, to wick into and be held. For example, the oil holding capacity of a microporous material typically ranges from 60–80%, or higher, as compared to aramid-type materials which have holding capacities of only about 10–50%.

Further, the microporous PTFE web of the present invention is much more conformable than other conventional nonwoven cleaning web materials. The high degree of porosity provides an extremely compliant and compressible material which can conform to scratches and defects in the critical imaging surface. In addition the microporous PTFE structure is extremely uniform and controlled. This high degree of uniformity provides a consistent cleaning performance.

The ePTFE material consists of nodes and fibrils. The fibrils typically range in diameter from that of microdenure materials to less than 20 nanometers.

The microporous PTFE of the present invention can be used to deposit a thin coating of PTFE onto a critical imaging surface under appropriate conditions. It is know that PTFE will shear and deposit a molecular layer of PTFE onto a mating surface when they are rubbed against one another. The transfer is increased at high temperature such as fusing temperature. The transferred layer of PTFE can be used to promote release of toner and other materials from the critical imaging surface.

Finally, because the contacting surface is 100% fluoropolymer, the frictional characteristics are much improved and reduced. The reduced friction provides less drag on the movement of the critical imaging surface, and subsequently less power to drive.

DESCRIPTION OF THE DRAWINGS

The operation of the present invention should become apparent from the following description when considered in conjunction with the accompanying drawings, in which.

DETAILED DESCRIPTION OF THE INVENTION

The present invention provides an improved apparatus for use in cleaning critical image surfaces. The apparatus of the present invention is particularly applicable to cleaning fixing rollers and belts, photoconductors, image transfer belts or rollers of laser printers, plain paper copiers, or fax machines, or other similar devices. For simplicity, such devices are collectively referred to herein as "printers," the rollers located in the fuser section of the printer are referred to as "fuser rollers," the image forming members are referred to as "photoconductors," and the surfaces in general requiring cleaning are referred to as "critical image surfaces."

Figure 1:
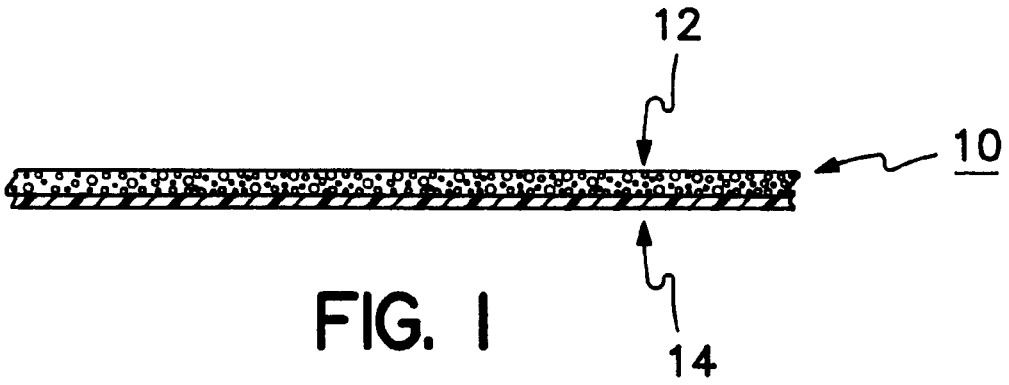
FIG. 1 is a cross-section view of the cleaning material of the present invention.

As is shown in FIG. 1, one embodiment of an cleaning apparatus 10 of the present invention comprises a microporous membrane layer 12 bonded to a substrate 14. Some types of the microporous membrane can be used without a substrate. The term "microporous membrane" as used in the present application is intended to mean a continuous sheet of material that is at least 50% porous (i.e., it has a pore volume of $\geqq 50\%$) with 50% or more of the pores being no more than about 20 $\mu$m in nominal diameter.

The novel materials of the present invention can clean while reducing what may be referred to as the necessary abrasion. As used herein, the "necessary abrasion" is the amount of abrasion needed to remove a particle from a critical imaging surface.

In cases where a substrate is necessary due to, for example, the high tensile forces during operation, the substrate material can be any number of materials, such as films or fabrics. Film substrate materials may comprise a polyester, polyamide, polyimide, polyetherpolyimide, polyethylene naphthalate (PEN), polytetrafluoroethylene (PTFE), perfluoroalkoxy (PFA), fluorinated ethylene propylene (FEP), or the like, depending on what is needed in the particular application. Fabric substrate materials may be nonwoven, such as a spunbonded, wet-laid, melt blown or felted polyester, nylon, polypropylene, aramid, or may be light woven material of polyester, nylon, polypropylene, aramid, PTFE, FEP, PFA, or the like. The substrate material is chosen to meet the specifications of the system, such as heat, mechanical, and chemical compatibility requirements.

The microporous membrane material of the apparatus of the present invention can be made from any one of several microporous materials, including expanded polytetrafluoroethylene (expanded PTFE), sintered polytetrafluoroethylene, and porous polyolefin (e.g., polypropylene). Preferably, the microporous membrane comprises a PTFE membrane, which is either an expanded network of polymeric nodes and fibrils made in accordance with the teachings of the U.S. Pat. Nos. 3,953,566, 3,962, 153, 4,096,227, and 4,187,390, all specifically incorporated herein in their entireties by reference, or a conglomerate of sintered PTFE particles made in accordance with the teachings of GB 2242431. These material are commercially available in a variety of forms from W. L. Gore & Associates, Inc., of Elkton, Md., Preferably, the expanded PTFE membrane of the present invention is made by blending PTFE fine particle dispersion, such as that available from E. I. duPont de Nemours & Company, Wilmington, Del., with hydrocarbon mineral spirits. The lubricated PTFE is compacted and ram extruded through a die to form a tape. The tape can then be rolled down to a desired thickness using calendering rollers and subsequently dried by passing the tape over heated drying drums. The dried tape can then be expanded both longitudinally and transversely at elevated temperatures above the glass transition temperature of the PTFE (greater than 300° C.), at a high rate of expansion, e.g., approximately 100 to 10,000% per second.

Moreover, depending on the desired application, one or more fillers may be incorporated with the expanded PTFE to alter the chemical, thermal or electrical properties of the material. For example, depending on the desired properties of the materials of the present invention, it may be possible to add one or more fillers, such as carbon, silica, silicon carbide, iron oxide, copper oxide, aluminum oxide, nickel and other metal oxides, manganese dioxide, boron nitride, and other similar fillers.

The expanded PTFE membrane employed in the present invention, should have the following properties: a thickness of about 0.0002" (0.00508 mm) to 0.125" (3.175 mm); a porosity of about 30 to 98%; and a bubble point (with isopropyl alcohol) of 0.4 to 60 psi (0.03 to 4.2 kg/cm$^2$). The preferred expanded PTFE membrane properties are: a thickness of about 0.0004" (0.010 mm) to 0.025" (0.635 mm); a porosity of about 70 to 95%; and a bubble point of about 1.0 to 30 psi (0.07 to 2.1 kg/cm$^2$).

The Bubble Point of porous PTFE is measured using a method similar to that set forth in ASTM Standard F316-86, incorporated by reference, with the following modifications: isopropyl alcohol is used instead of denatured alcohol; and area tested is about 10 mm diameter (78.5 mm$^2$). The Bubble Point is the pressure of air required to blow the first continuous bubbles detectable by their rise through a layer of isopropyl alcohol covering the PTFE media.

Preferably, the sintered PTFE membrane of the present invention is formed from a mixture of particles of different grades of granular-type polytetrafluoroethylene (PTFE), such as described in British Publication GB 2242431, mentioned earlier herein. A particularly useful product for use in the present invention is formed from a mixture of unsintered and sintered granular type PTFE particles, for example 40% to 60% of TEFLON® resin grade 7A; and 40% to 60% of TEFLON® resin grade 9B. However, generally speaking from 0–100% unsintered PTFE (e.g. grade 7A) and conversely 100-0% sintered PTFE (e.g. grade 9B) may be used to produce the sheet material. TEFLON® granular-type resin grades 7A and 9B are available from DuPont Specialty Polymers Division, Wilmington, Del. The porous polytetrafluoroethylene structure is usually prepared by spraying onto a substrate, such as a ceramic tile or sheet of metal, and then peeling the formed structure from the substrate. The material usually has a specific gravity of 0.5 to 1.8, for example 0.6 to 1.5, typically 0.7 to 1.2. In comparison, pure non-porous PTFE typically has a specific gravity of 2.16. Generally speaking, the sheet material has a thickness of 50 to 1500 microns, particularly 150 to 1000 microns.

Figure 2:
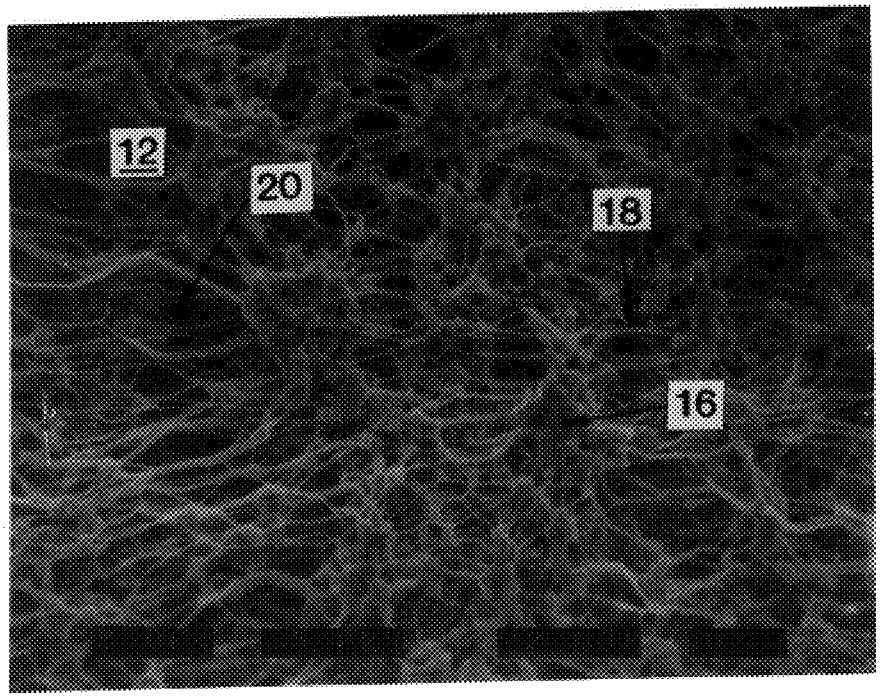
FIG. 2 is a scanning electron micrograph (SEM) of expanded PTFE material, enlarged 5,000 times.

The expanded PTFE product is illustrated in FIG. 2. The expanded PTFE material 12 comprises polymeric nodes 16 interconnected by polymeric fibrils 18. Microscopic pores 20 are left between the nodes and fibrils that can be employed in the present invention. This structure is explained in greater detail below.

Figure 3:
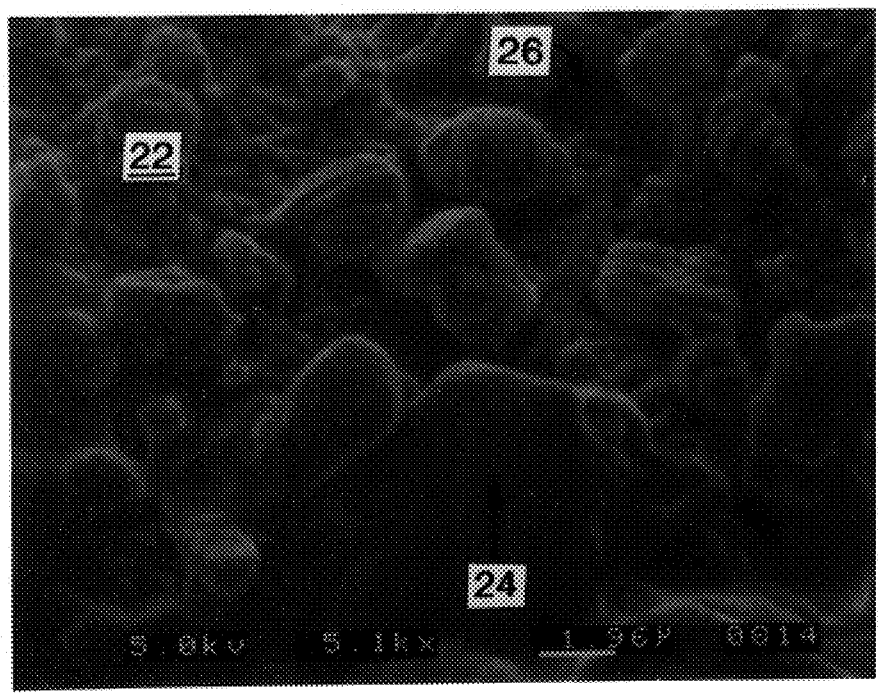
FIG. 3 is a SEM of a sintered PTFE material, enlarged 5,100 times.

The sintered PTFE 22, as shown in FIG. 3, is typically formed from sintered or unsintered PTFE particles 24 packed together to form a sheet.

Figure 4:
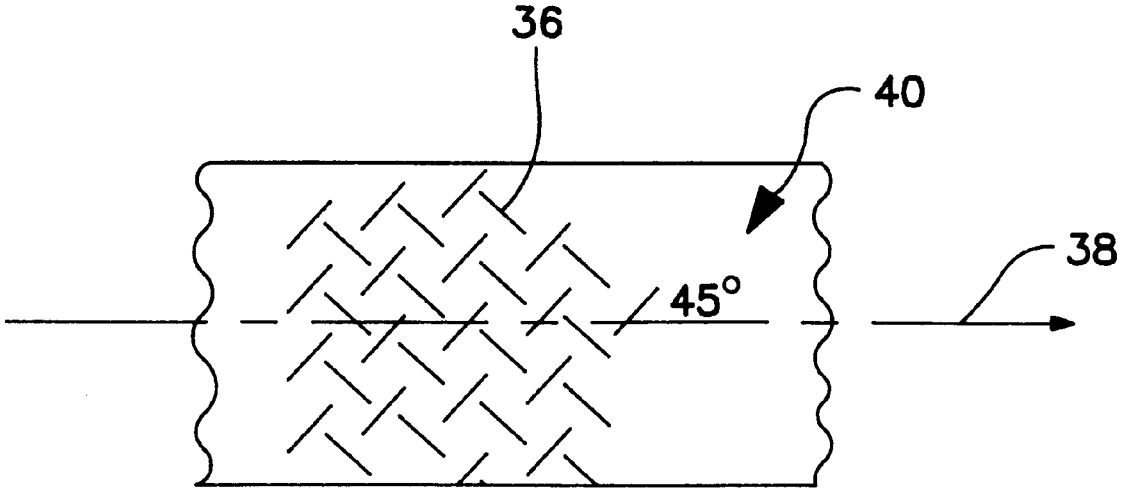
FIG. 4 is a top plan view of the expanded PTFE membrane used in the present invention with a densified pattern.
Figure 5:
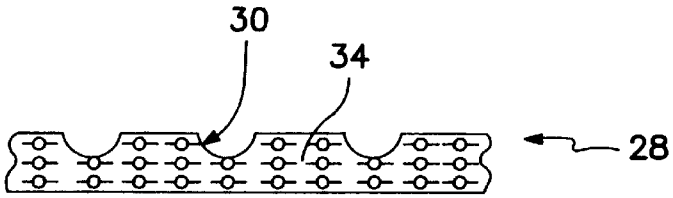
FIG. 5 is an enlarged cross-sectional view of expanded PTFE used in the present invention having a densified pattern therein.

By imprinting a pattern of peaks and valleys on to the PTFE membrane, better offset toner and dirt holding capacity may be realized. As is shown in FIG. 4, an expanded PTFE layer 28 is shown with densified regions 30 forming grooves therein. These densified regions form a pattern between operating surfaces 34 on the expanded PTFE layer 28. The pattern can be imparted into the expanded PTFE membrane using a number of techniques. The preferred method is to laminate the membrane to a nonwoven structure. During lamination, the membrane conforms to the surface topography of the substrate. Another method of producing a pattern is through densification of the fluoropolymer in specific areas. For example, densification of a pattern can be achieved by imparting high pressure with high temperature to localized areas. This may be done by passing the membrane through a heated nip in which at least one of the heated rollers has selectively raised sections. Alternatively, the pattern may be imparted to the material by passing the expanded PTFE membrane through a heated nip with a material which has a pattern within it, such as a fabric or a wire cloth. One exemplary method of imparting a pattern into the expanded PTFE membrane is through the use of ultrasonic embossing. The expanded PTFE membrane can be passed through a rotating embossed metal roller, and a stationary or rotating ultrasonic horn, such as that available from Sonobond Ultrasonics, West Chester, Pa. The metal roller is pressed down onto the expanded PTFE membrane as it passes through the nip. The web speed, the pressure, and the amplitude of the ultrasonic horn can all be adjusted to produce the desired pattern. The formation of the expanded PTFE membrane pattern with ultrasonics provides regions that are thermally fused and crushed under pressure. These regions will not re-expand under stress. The areas around the densified regions using ultrasonic embossing will be, for the most part, unchanged. The preferred pattern is dependent on the application and the amount of toner pick up that is necessary. The preferred pattern shown in FIG. 5, comprising a discontinuous knurled pattern 36, with the axis of the densified elements at approximately a 45° angle to the direction of travel 38 of the web 40.

Figure 6:
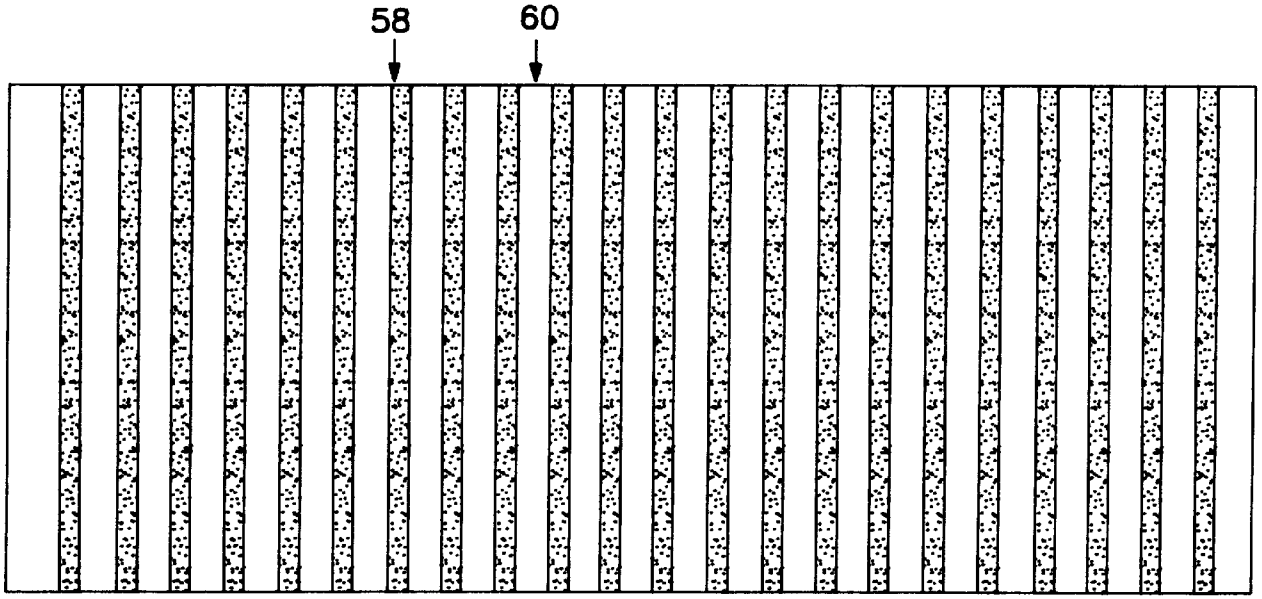
FIG. 6 is a top plan view of the sintered PTFE membrane used in the present invention with a grooved pattern.
Figure 7:
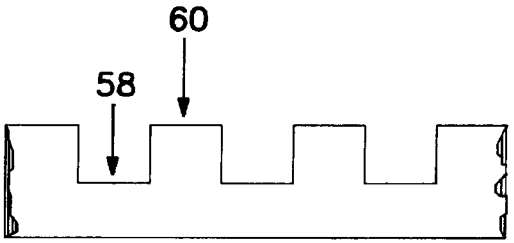
FIG. 7 is an enlarged cross-sectional view of the sintered PTFE membrane used in the present invention having a grooved pattern therein.

A pattern may also be imparted to the sintered PTFE structure during manufacture. The granular particles can be sprayed onto a patterned surface (e.g. a mesh screen). When the material is pulled off, the inverse of the pattern is transferred to the material. For example, FIGS. 6 and 7 show a top plan view and a cross-sectional view, respectively, of a sintered PTFE membrane with a grooved pattern. When the material is pulled off of the patterned surface, the pattern produces indented areas 58 and raised areas 60. In use, the raised areas 58 push particulates off of the critical image surface and the indented areas 60 capture the particulates. Alternative pattterns may also be used, depending on, for example, the configuration of the apparatus, the material, etc.

A PTFE membrane is a preferable cleaning apparatus material for a variety of reasons. First, the chemical inertness and relatively high heat resistance of PTFE makes it desirable for use in the fuser section of printers in which the typical temperature is 160–220° C.

Second, the PTFE membranes have high capillary action, which absorb liquid contaminate quickly and evenly. Particularly, the rate of absorption can be tightly controlled by adjusting one or more of a number of different properties. For instance, dimensions, porosity, equivalent pore size and other features of the PTFE membrane may be modified to provide specific properties. Over time, the voids of the microporous PTFE will be filled with the fluid through capillary action. Any type of release agent may be used, such as silicone fluid, hydrocarbon fluids, alcohols, functionalized silicone fluids, water and the like. The preferred release fluid for most printer applications is dimethylsiloxane fluid, or silicone oil. For example, expanded PTFE can hold up to 80%, or higher, of it's original volume in oil compared to typical nonwovens used in the industry which hold 10–50%.

Third, the cleaning pattern formed on the membrane may be varied by depth and amount of raised surface area.

Fourth, PTFE has a low coefficient of friction and exceptional wear characteristics, reducing wear on component parts and extending operational life of the apparatus. Therefore, the web cleans because of the pattern or microporous structure, not because of abrasion.

Fifth, under certain conditions, the PTFE membrane can be readily cleaned of deposited toner and other contaminates because of its low surface energy. This enables the use of belts or covered rollers because the surface can be cleaned internally before re-contact with the critical image surface.

Sixth, the expanded PTFE can be made extremely thin, down to 0.0002" (0.005 mm), and still be strong, with a matrix tensile strength of about 10,000 to 20,000 psi (703 to 1406 kg/cm$^2$), or higher. Because the expanded PTFE membrane is so thin and extremely microporous, long lengths of web material can be rolled onto a core and kept within the space constraints of the system. This means that for a given indexing speed, the web will last much longer than conventional web materials. This saves not only on materials, but also on time to replace old webs.

Seventh, because of the processing techniques, microporous PTFE is extremely uniform. Therefore, contamination is removed/absorbed uniformly.

Eighth, when PTFE is rubbed across a mating surface the PTFE shears and transfers a molecular layer of PTFE. This transferred layer maintains a low surface energy coating on a continuous basis, which results in lower adhesion of contaminate. The transferred layer also lowers the traction coefficient between the mating surface and the PFTE. This decrease in traction lowers the amount of torque required to drive the web and the mating surface.

Ninth, the microporous PFTE structure is capable of containing fillers within its structure. This feature provides significant advantages over such techniques as solution coating, in which the coatings tend to flake, adding to the level of contamination. The addition of fillers in the method of the present invention does not result in contamination due to cracking, flaking or wearing.

The preferred method of construction of the cleaning apparatus of the present invention bonds the expanded PTFE to a substrate material in order to increase strength and structural integrity of the apparatus. The expanded PTFE membrane can be bonded to the substrate using any number of standard industrial techniques, depending on what is chosen as the substrate. If the substrate is thermoplastic, the expanded PTFE may be bonded by passing the expanded PTFE and the thermoplastic layer through a heated nip with the expanded PTFE against the heated roller. The thermoplastic will melt and flow into the expanded PTFE membrane, forming a mechanical bond.

If the material is thermoset, the expanded PTFE membrane may be bonded by using a suitable adhesive, such as silicone, pressure sensitive adhesive, acrylic, polyester, nylon, epoxy, and the like. The adhesive may be provided to the substrate and the expanded PTFE membrane in any desirable manner and/or configuration depending on, for example, the composition of the material to be bonded, etc. In one preferred embodiment, the adhesive may be provided in a discontinuous pattern between the surfaces to be joined, thereby minimizing any thermal expansion or shrinkage between and/or within the bonded layers.

The cleaning apparatus of the present invention may comprise any of a number of desirable forms, such as a web, a pad, a roller or the like.

Figure 8B:
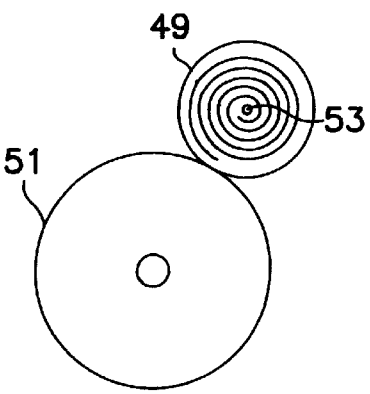
FIGS. 8*a*,8*b* and 8*c* are side elevation views of a pad material, a roller material and a web material, respectively, of the present invention in contact with a critical image surface.
Figure 8A:
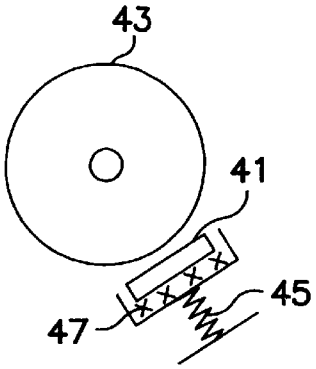

In one embodiment of the present invention, as shown in FIG. 8*a,* the microporous membrane 41 may be contacted with the critical imaging surface 43 in the form of a cut sheet, or pad, with some means 45 to press the cleaner against the critical imaging surface. In addition, the microporous membrane may be attached to a backing material 47. Moreover, a combination of two or more microporous membranes may be utilized in the cleaner pad configuration. For example, an ePTFE membrane may be used in combination with a sintered PTFE or a comparable woven or non-woven material.

In another embodiment of the present invention, the microporous membrane may be applied to a critical image surface in the form of a roller. As shown in FIG. 8*b,* the microporous membrane 49 may be wrapped or pulled over the shaft of a roller 53 and then mounted in a manner to permit contact of the roller with the critical imaging surface 51. The microporous membrane may comprise, for example, a wrapped sheet, an extruded expanded tube, or the like. In addition, multiple microporous membranes may be used in combination in the roller configuration. For example, in one embodiment, a sheet of sintered PTFE may be wrapped around a roller mandrel, then an extruded tube of ePTFE membrane may be pulled over the wrapped mandrel. In a further embodiment, a woven or nonwoven textile may be placed onto the mandrel as a component of the substrate, then the microporous membrane may be applied to the substrate. In an alternative embodiment specifically for fluid cleaning, the mandrel may have one or more holes therein, or may comprise a porous material, whereby a vacuum could be pulled from the interior of the mandrel to collect the fluid that is collected by the microporous membrane.

In another embodiment, the cleaning apparatus of the present invention may comprise a cleaning web. The web assembly may comprise any configuration which is desirable to clean at least one contact surface of the printer device. For example, the web is typically positioned so as to continually provide a clean web surface to contact the critical image surface. The assembly may comprise one or more rotating members in order to meet this need. In a preferred embodiment of the present invention, the web assembly comprises at least two rotating members which permit the web and the contact surface to move relative to each other.

Figure 8C:
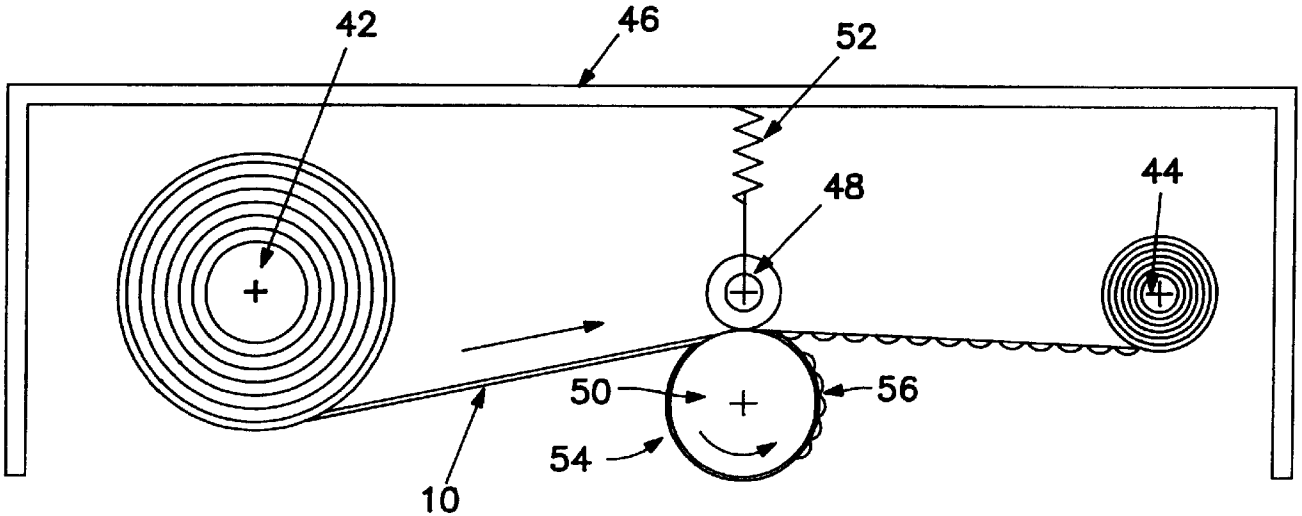

Shown in FIG. 8*c* is one apparatus for employing a web 10 of the present invention. This apparatus comprises a payoff shaft 42, a take-up shaft 44, a housing or frame 46, and a pressing roller or member 48 that can apply pressure to hold the web 10 to a photoconductive drum 50. Preferably, the pressing roller or member 48 is spring loaded or includes some other form of mechanical biasing device 52 to maintain contact with the fixation roller 50. Cut to the correct operating size, the web material 10 is preferably mechanically attached or adhesively bonded (hereafter collectively referred to as "attached") to both the payoff shaft 42 and the take-up shaft 44, with the web initially wound on the payoff shaft upon installation and then steadily transferred to the take-up shaft during operation. Once the web 10 is completely transferred to the take-up shaft, the web assembly (i.e., the web 10 and both shafts 42, 44) can then be replaced. Alternatively, the web assembly may include the entire apparatus mounted on the frame 46, which can be replaced as a whole each time the web must be replaced.

Where the web is attached by adhesive to the shafts 42, 44, a variety of adhesives can be used to bond the web to the shaft, including silicone rubber, acrylic, polyester, epoxy, pressure sensitive adhesive, and urethanes. Alternatively, the web 10 may be attached by clips, slots, or other mechanical devices to one or both of the two shafts.

In the apparatus described, the web 10 is ideally automatically indexed past the critical image surface 50 as the printer is used. The elastomeric roller or member 48 pushes down on the web 10 and presses the web against the photoconductive drum 50. This transfers a layer of PTFE 54 onto the fuser roller 50. Simultaneously, contaminates (e.g., dirt, toner particles and excess fluid) 56 on the photoconductive drum 50 are transferred onto the web 10 where it contacts the photoconductive drum 50.

In this manner, toner particles 56 adhered to the photoconductive drum are cleaned off as the drum passes the web 10. Furthermore, a fresh release layer of PTFE 54 is smeared on the fuser roller 50 to protect against adhesion of paper and toner 58 to the photoconductive drum 50.

Figure 9:
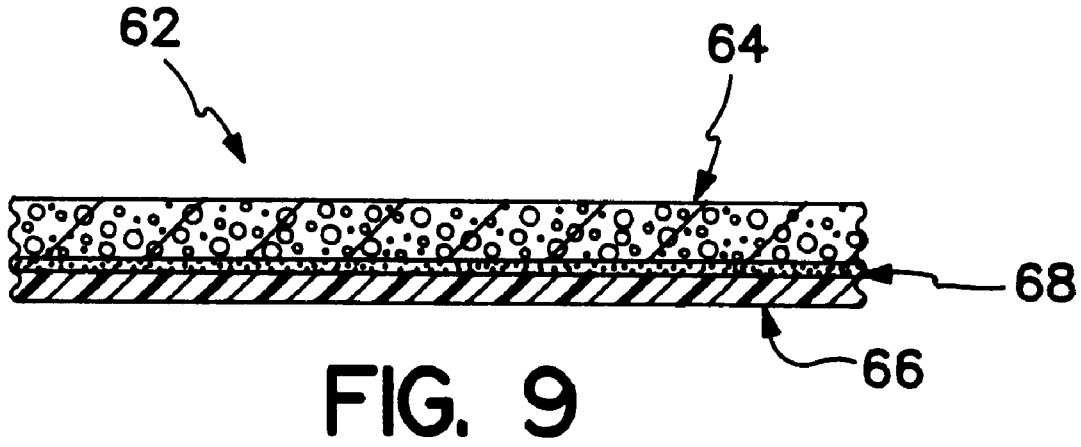
FIG. 9 is an enlarged cross-sectional view of a cleaning apparatus of the present invention.

One embodiment of the web material of the present invention is depicted in FIG. 9. The web material 62 comprises an expanded PTFE membrane 64 bonded to a polyester nonwoven 66. The membrane 64 and the substrate 66 are adhered together along layer 68, comprising the polyester layer 66 melted and flowed into and around the nodes and fibrils of the expanded PTFE membrane 64. When the polyester cools and hardens, the polyester and expanded PTFE are mechanically adhered together.

Figure 10:
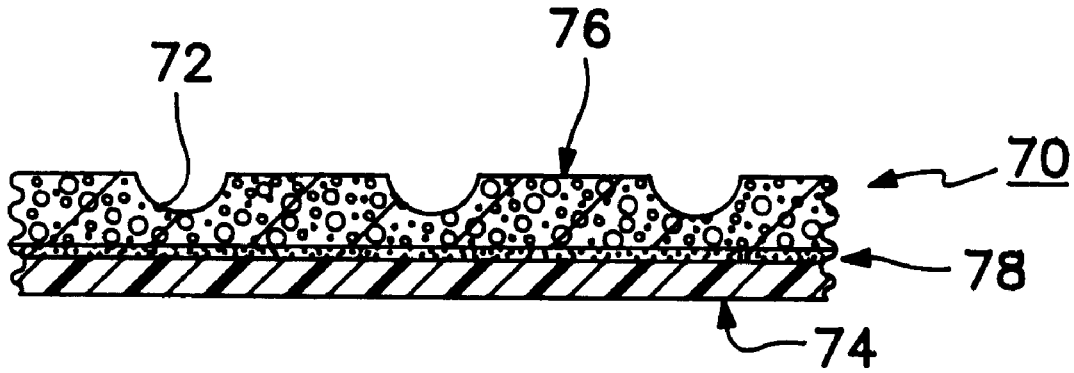
FIG. 10 is an enlarged cross-sectional view of another embodiment of a cleaning apparatus of the present invention.

Another embodiment of the web material of the present invention is depicted in FIG. 10. The substrate material 74 is a polyester film material which is impermeable to fluids. The substrate material 74, is bonded to expanded PTFE membrane 76 using an adhesive 78. The adhesive 78 chemically bonds to the substrate material 74 and mechanically bonds to the expanded PTFE membrane 76.

One of the main advantages of the present invention is that it provides a much lower friction coefficient than has been previously possible. Previous cleaning webs constructed from NOMEX®, acrylic, and polyester could only support a minimal normal force before becoming abrasive. By contrast, the web made in accordance with the present invention can withstand a much greater force before abrasion.

Moreover, another significant advantage of the present invention is the use of a suitable adhesive to bond the expanded PTFE membrane to a substrate. For example, as mentioned earlier herein, by providing the adhesive in a discontinuous pattern, thermal expansion and/or shrinkage stresses between and/or within the bonded layers may be significantly minimized.

Figure 11:
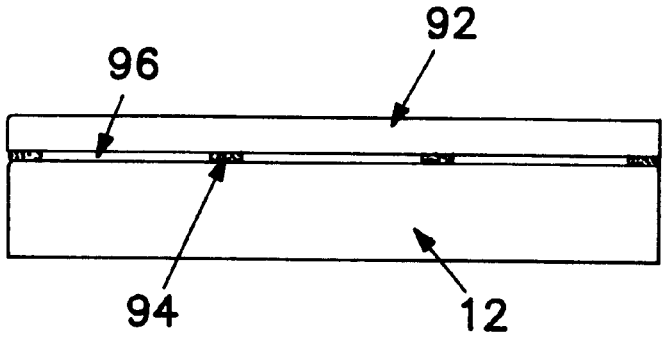
FIG. 11 is an enlarged cross-sectional view of the web material used in the present invention having a gravure print adhesive pattern.
Figure 12:
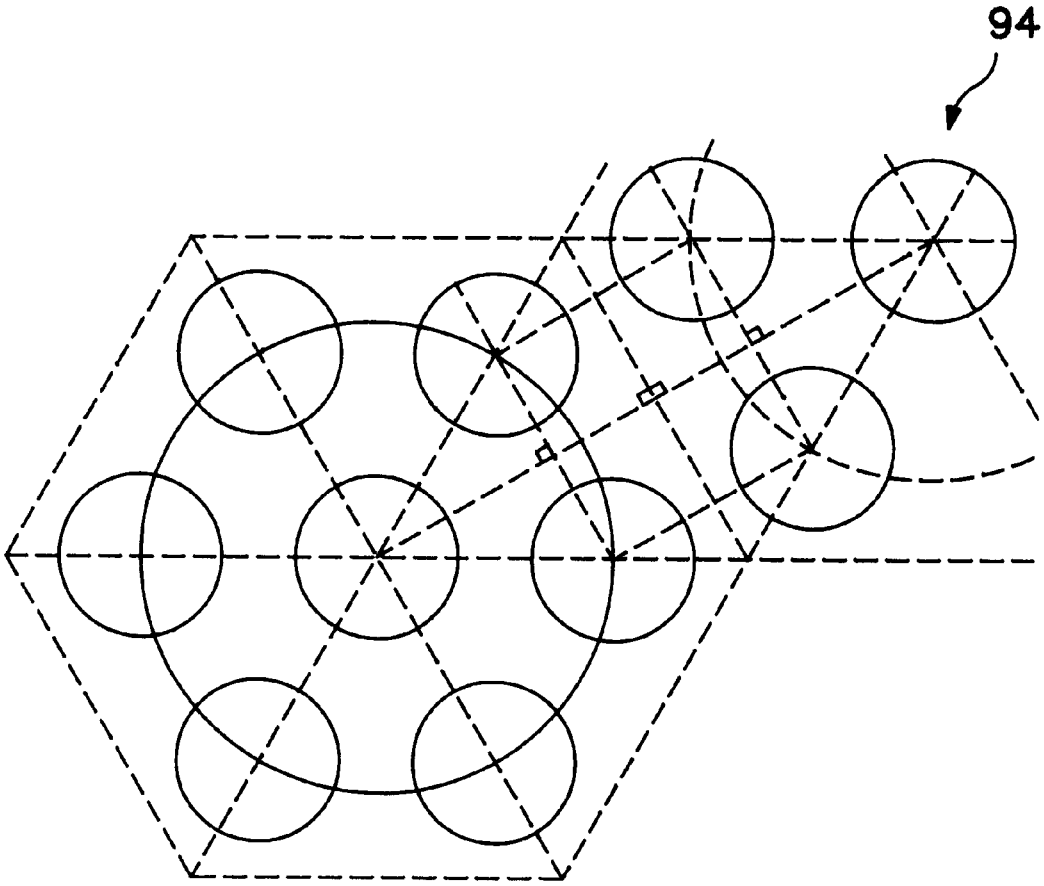
FIG. 12 is a top plane view of a rosette gravure pattern.
Figure 13:
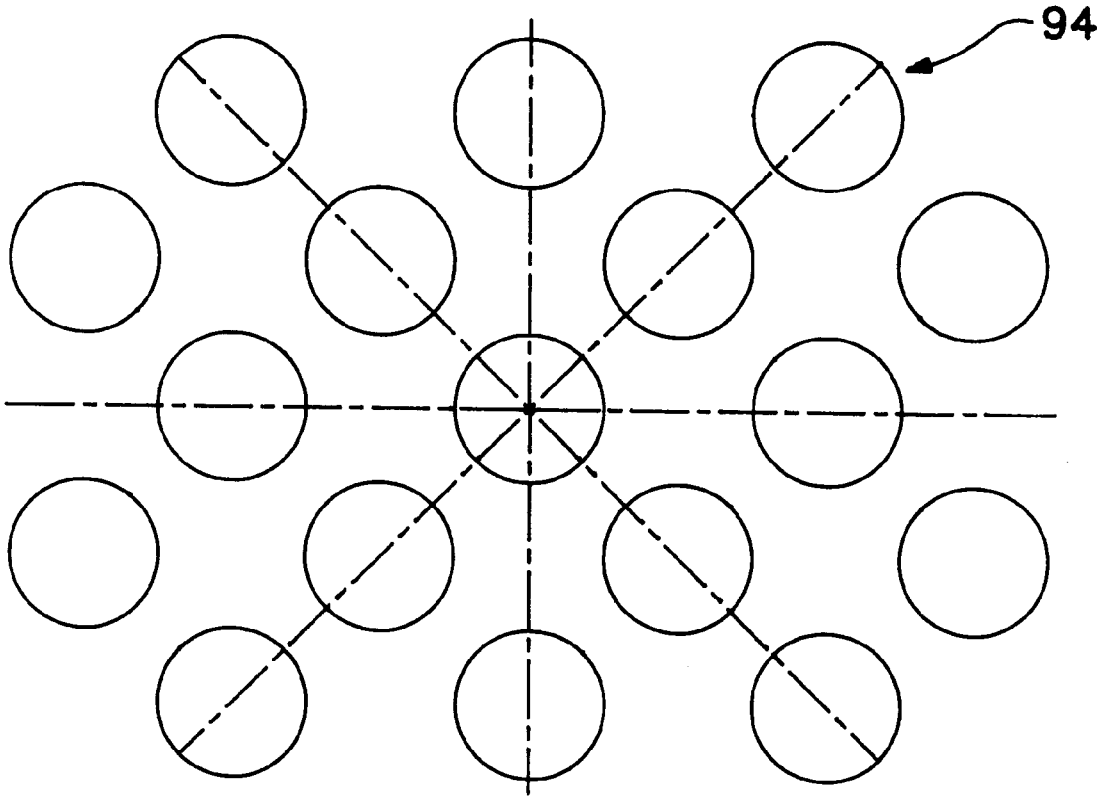
FIG. 13 is a top plane view of a 45° gravure pattern.

As depicted in FIG. 11, application of a discontinuous pattern comprising a gravure printed adhesive between the microporous membrane 12 and a continuous film backing 92 provides areas of adhesive dots 94 and areas of non-adhesion 96. The adhesive dots 94 can be placed in numerous configurations—two of which are displayed schematically in FIGS. 12 and 13. When the composite of the present invention is subjected to a normal fusing temperature, such as, for example, 150–250° C., the layers of the composite may shrink to varying degrees. In instances where the microporous membrane 12 shrinks to a greater degree than the continuous film backing 92, a tension gradient is built up between the layers. If the adhesive is discontinuously printed into, for example, discrete dots 94, the tension may be localized and controlled between the adhesive dots.

Without intending to limit the scope of the present invention, the following examples illustrate how the present invention may be made and used:

EXAMPLE 1

An expanded PTFE membrane (thickness 0.008" (0.20 mm), bubble point 13.6) from W. L. Gore & Associates, Inc., Elkton, Md., was adhered to a solid 0.001" (0.0254) mm thick polyethylene naphthalate (PEN) film, Kaladex® 2000 from ICI Films, Wilmington, Del., through a lamination procedure. The adhesive, 1081-4104 from GE Silicones, Waterford, N.Y., was applied to the PEN film with a chrome roller in counter-current contact with a smooth silicone roller in counter-current contact with an offset gravure roller rotating at 3–4 ft/min (1–1.3 m/min). The film then contacted the membrane under a nip roller. The lab line moved at 1.6–1.7 ft/min (48–50 cm/min) through a 15' (4.5 m) IR oven at 130–140° C.

The material was then saturated with 500 cst 200® Fluid, Dow Corning Corporation, Midland, Mich., by wiping an excess amount onto the membrane surface and allowing the fluid to fully permeate the membrane. Any excess fluid was wiped off until the membrane surface retained no shine. The achieved web material had the following characteristics: 77% oil volume/web volume, 0.008" (0.20 mm) thickness, 132 g/m$^2$ oil/web area, and 654 kg/m$^2$ oil/web volume.

EXAMPLE 2

An expanded PTFE membrane (thickness 0.0035" (0.09 mm), bubble point 18) from W. L. Gore & Associates, Inc., Elkton, Md., was adhered to a solid 0.001" (0.025 mm) thick polyethylene naphthalate (PEN) film, Kaladex® 2000 from ICI Films, Wilmington, Del., through a lab line procedure. The adhesive, 1081-5013 from GE Silicones, Waterford, N.Y., was applied to the PEN film by offset gravure (15% coverage, 130 micron wells) at 3–4 fpm (1–1.3 m/min). The film then contacted the membrane under a nip roller. The composite moved at 1.6–1.7 fpm (48–50 cm/min) through a 15' (4.5 m) IR oven at 130–140° C. The material was then slit to 12" (30 cm) width and placed onto two 12.3" (31 cm) long, 0.40" (1.0 cm) diameter aluminum shafts with DEV-7163 pressure sensitive adhesive from Adhesives Research, Inc., Glen Rock, Pa.

Figure 14:
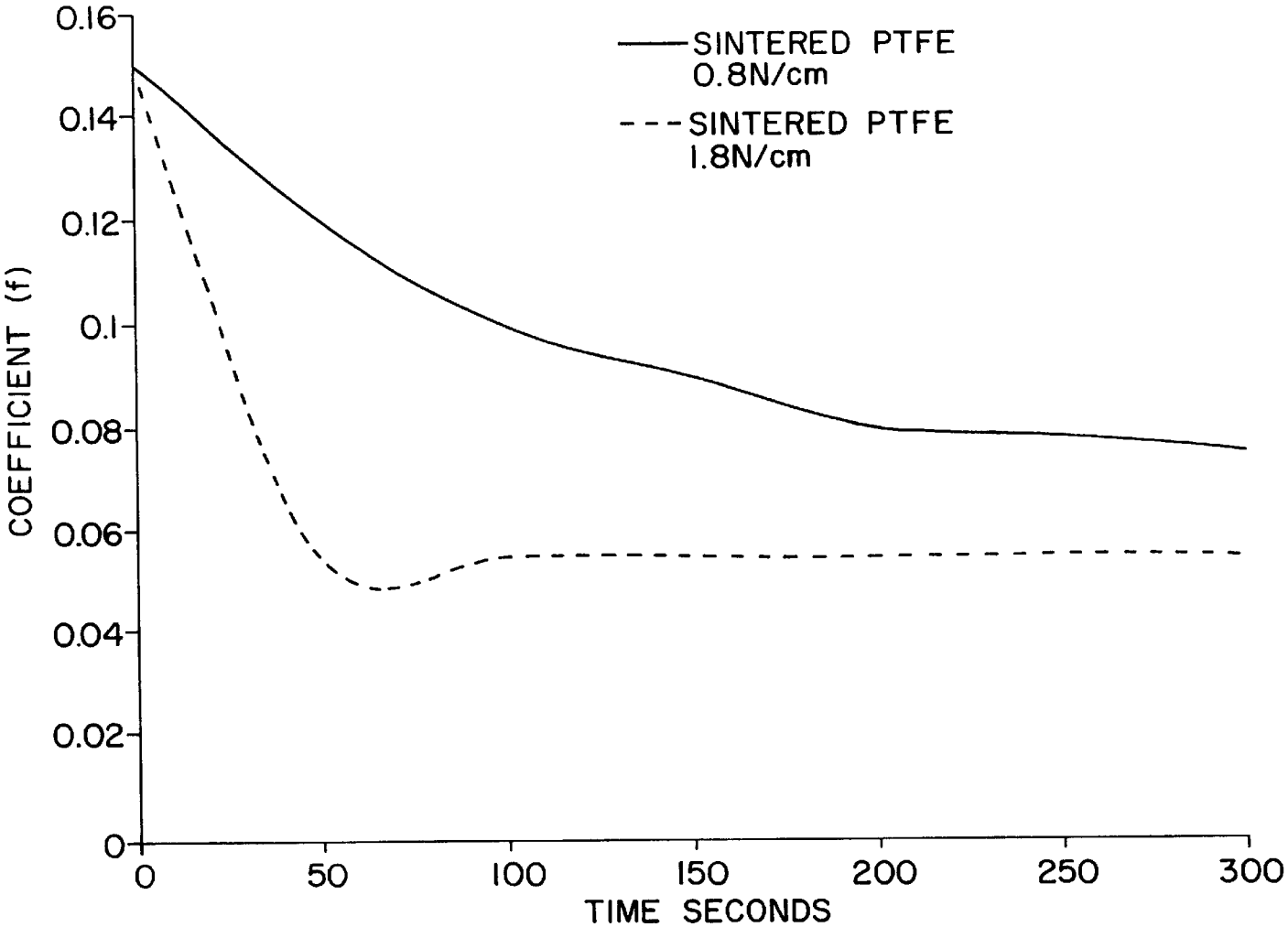
FIG. 14 is a top plane view of a web material made in accordance with Example 2.
Figure 15:
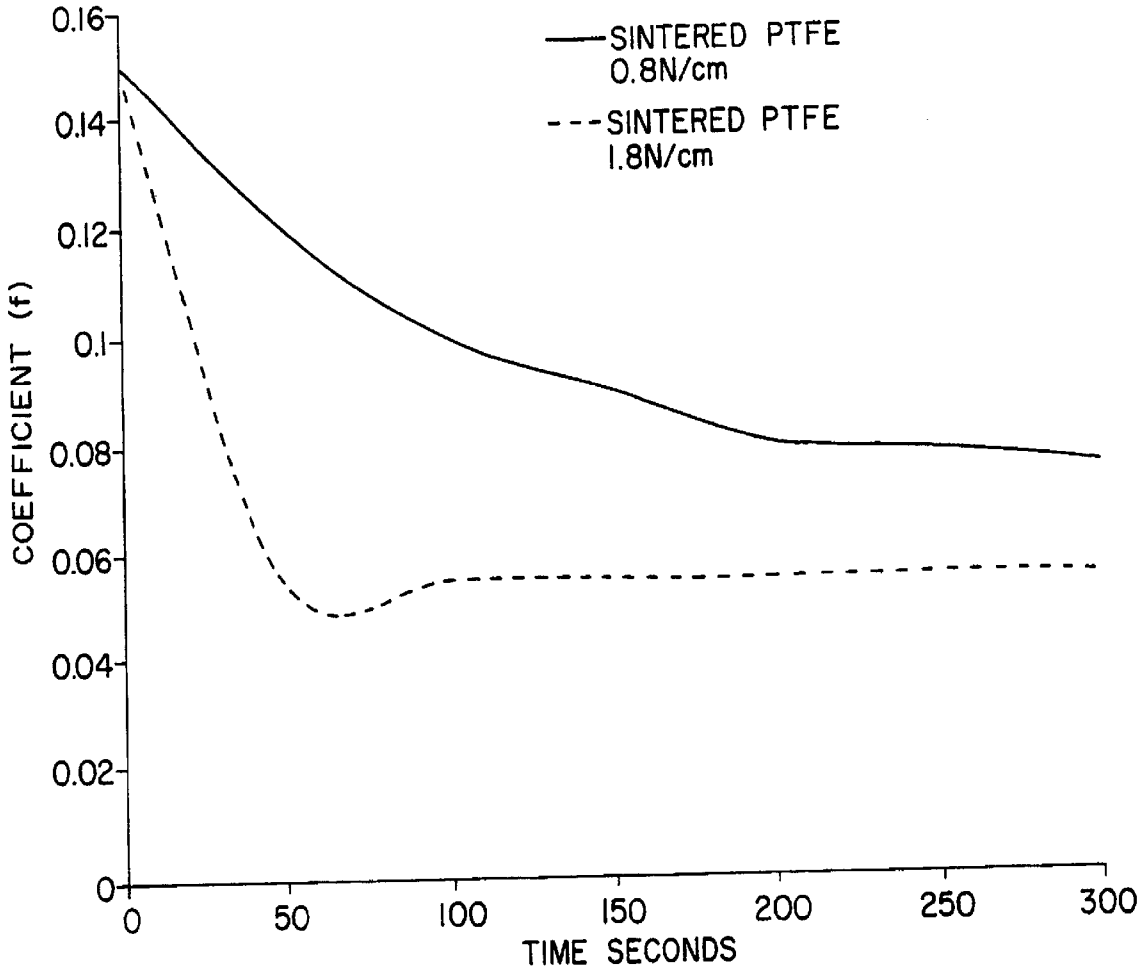
FIG. 15 is a graph of coefficient of friction as a function of time for the materials tested in Example 3.

The area of the web that was run through the copier was then measured for thickness variations. Measurements were taken throughout the center section and along the paper edge. FIG. 14 is a top plane view, microporous membrane up, of the web material with continuous adhesive.

| Center (mil) | Edge (mil) |
|---|---|
| 6.1 | 2.7 |
| 4.3 | 2.6 |
| 6.5 | 2.6 |
| 4.4 | 2.6 |
| 4.5 | 2.7 |
| 6.8 | 2.8 |
| 4.6 | 2.7 |
| 7.1 | 2.7 |

These results were then compared to the same material with a gravure printed adhesive. An expanded PTFE membrane (thickness 0.0035" (0.09 mm), bubble point 18) from W. L. Gore & Associates, Inc., Elkton, Md., was adhered to a solid 0.001" (0.025 mm) thick polyethylene naphthalate (PEN) film, Kaladex® 2000 from ICI Films, Wilmington, Del., through a lab line procedure. The adhesive, 08-211-3 from Performance Coatings Corporation, Levittown, Pa., was applied to the PEN film with a gravure roller (15% coverage, 130 micron wells) rotating at 30 fpm (10 m/min). The film then contacted the membrane under a nip roller. With the membrane side toward a 12" (30 cm) wide, 300 watt, mercury UV lamp, the adhesive was cured at 30 fpm (10 m/min). The material was slit to 12" (30 cm) width and placed onto two 12.3" (31 cm) long, 0.40" (1.0 cm)diameter aluminum shafts with DEV-7163 pressure sensitive adhesive from Adhesives Research, Inc., Glen Rock, Pa.

The area of the web that was run through the copier was then measured for thickness variations. Measurements were taken throughout the center section and along the paper edge.

| Center (mil) | Edge (mil) |
|---|---|
| 2.7 | 3.3 |
| 2.6 | 3.2 |
| 2.8 | 3.2 |
| 2.7 | 3.1 |
| 2.9 | 3.2 |
| 2.7 | 3.0 |
| 2.6 | 3.4 |
| 2.5 | 3.3 |

As demonstrated by the large variation between center and edge thickness measurements for the continuous film composite, a dramatic difference exists in the operating performance. The numerous 0.015 to 0.0045" (0.38 to 0.114 mm) deep ridges 98 present in the continuous film adhesive composite are not present in the gravure printed adhesive composite. These ridges, which appear to result from the uncontrolled tension gradient between the microporous membrane and the continuous film backing, dramatically increase take-up diameter and tracking problems.

EXAMPLE 3

As discussed earlier, the microporous membrane of the present invention is capable of reducing the surface energy and friction characteristics of the critical image surface. Specifically, it has been observed that PTFE will smear and transfer at least a molecular layer of PTFE onto a mating surface when it is pressed and rubbed against it. The present example demonstrates this feature.

A 3 inch (76 mm) diameter polished metal mandrel rotating at approximately 60 revolutions per minute was contacted with a friction probe so that the coefficient of friction of the mandrel could be measured continuously. A piece of sintered PTFE made in accordance with GB 2242431 was then pressed against the metal with a force of 0.8N/cm using a rigid rod approximately 10 mm in diameter. A second sample of sintered PTFE was then pressed against the mandrel at a pressure of about 1.8N/cm. FIG. 14 shows the coefficient of friction as a function of time for both the sample pressed against the mandrel at 0.8N/cm and the sample pressed at 1.8N/cm. As can be seen from the graph, the coefficient of friction decreased significantly for both samples as the PTFE samples were rubbed against the mandrel.

EXAMPLE 4

Two samples measuring 2 inches by 5 inches (51 by 127) were first obtained, as described below.

The first sample was a non-woven aramid web, Part # 141-052 (Veratec, Athena, Ga.) with the following characteristics: 0.0787 mm thickness, 28.7/m$^2$ weight, 7.9 MD and 1.4 CD kg/50 mm strip tensile, and 1.5% MD and 0% CD heat shrinkage (30 min @ 200° C.).

The second sample was an expanded PTFE membrane (thickness 0.0035" (0.09 mm), bubble point 18) from W. L. Gore & Associates, Inc., Elkton, Md., adhered to a solid 0.001" (0.025 mm) thick polyethylene naphthalate (PEN) film, Kaladex® 2000 from ICI Films, Wilmington, Del., through a lab line procedure. The adhesive, 08-211-3 from Performance Coatings Corporation, Levittown, Pa., was applied to the PEN film with a gravure roller (15% coverage, 130 micron wells) rotating at 30 fpm (10 m/min). The film then contacted the membrane under a nip roller. With the membrane side toward a 12" (30 cm) wide, 300 watt, mercury UV lamp, the adhesive was cured at 30 fpm (10 m/min).

The two samples were stretched across U-shaped weights (233 g) and placed against a soft silicone fuser roller Part #22k20701 (Xerox Corporation, Rochester, N.Y.), which was orange in color. The roller was rotated at a rate of 10 rpm for 16 hours.

It was observed that the Veratec sample abraded the silicone roller. The shredded orange silicone rubber debris was visible in the non-woven and on the fuser roller. The Gore sample showed no orange rubber abrasion on its surface or on the surface of the fuser roller.

The invention claimed is:

1. A cleaning assembly for mounting in a printer device employing at least one critical image surface, comprising:

an assembly consisting essentially of an expanded polytetrafluoroethylene (PTFE) membrane exhibiting a node and fibril structure and in the absence of a release agent and a means for contacting at least a portion of the expanded PTFE membrane with the critical image surface; and means for moving at least one of the assembly and the critical image surface relative to each other, whereby during said moving contaminates on the critical image surface are transferred to the assembly and held by the expanded PTFE membrane.

2. The cleaning assembly of claim 1 wherein the critical image surface comprises a photoconductor.

3. The cleaning assembly of claim 1, wherein said membrane has at least one patterned surface.

4. The cleaning assembly of claim 1, wherein the assembly comprises an elongated web of material attached between at least two rotating members so as to place the web into contact with the critical image surface, and wherein the assembly is adapted to advance to move a clean portion of the assembly into contact with the critical image surface.

5. The cleaning assembly of claim 1, wherein the assembly comprises a pad which is pressed against the critical image surface.

6. The cleaning assembly of claim 1, wherein the assembly comprises a roller which is placed into contact with the critical image surface.

7. The cleaning assembly of claim 1, wherein said expanded PTFE membrane includes at least one filler.

8. A cleaning web assembly for mounting in a printer having at least one critical image surface, the cleaning web assembly consisting essentially of:

an expanded polytetrafluoroethylene (PTFE) membrane exhibiting a node and fibril structure and in the absence of a release agent;

a substrate material attached to the expanded PTFE membrane;

the expanded PTFE and substrate material comprising an elongated web of material attached between at least two rotatable members so as to place the web into contact with the at least one critical image surface;

means for rotating the at least two rotatable members, whereby the web and the critical image surface move relative to each other, transferring contaminates on the critical image surface to the web to be held by the expanded PTFE membrane; and wherein the web assembly is adapted to advance the web to move a clean portion of the web into contact with the critical image surface.

9. The cleaning assembly of claim 8, wherein said substrate material comprises a material selected from the group consisting of polyester, polyamide, polyimide, aramid, polyethylene napthalate (PEN), polytetrafluoroethylene (PTFE), perfluoroalkoxy (PFA) and fluorinated ethylene propylene (FEP).

10. The cleaning web assembly of claim 8 wherein the expanded PTFE membrane includes a densified pattern therein.

11. The cleaning web assembly of claim 8 wherein the critical image surface comprises a photoconductor.

12. The cleaning web assembly of claim 8 wherein the expanded PTFE membrane has a porosity of at least 50%.

13. The cleaning web assembly of claim 8 wherein said expanded PTFE membrane includes at least one filler.

14. The cleaning web assembly of claim 8, wherein said substrate material is attached to said expanded PTFE membrane by a curable adhesive.

15. The cleaning web assembly of claim 14, wherein said curable adhesive is present in a gravure printed pattern with said assembly.

16. The cleaning web assembly of claim 14, wherein said curable adhesive is curable by UV energy.

17. The cleaning web assembly of claim 16, wherein said curable adhesive is present in a gravure printed pattern within said assembly.

* * * * *